US006253840B1

(12) United States Patent
Kuroyanagi

(10) Patent No.: US 6,253,840 B1
(45) Date of Patent: Jul. 3, 2001

(54) REFRIGERANT EVAPORATOR INCLUDING REFRIGERANT PASSAGE WITH INNER FIN

(75) Inventor: Isao Kuroyanagi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/247,773

(22) Filed: Feb. 9, 1999

(30) Foreign Application Priority Data

Feb. 10, 1998 (JP) ..... 10-028727

(51) Int. Cl.[7] ..... F28F 1/14

(52) U.S. Cl. ..... 165/183; 165/153; 165/174; 165/177

(58) Field of Search ..... 165/153, 177, 165/174, 176, 183, 179, 166; 62/515

(56) References Cited

U.S. PATENT DOCUMENTS 4,729,428 * 3/1988 Yasutake et al. ..... 165/166
4,899,808 * 2/1990 Gregory et al. ..... 165/166 X
4,945,981 * 8/1990 Joshi ..... 165/166 X

FOREIGN PATENT DOCUMENTS

1126532 * 9/1968 (GB) ..... 165/179
58-221390 * 12/1983 (JP) ..... 165/183
59-76886 5/1984 (JP) .
1-98896 * 4/1989 (JP) ..... 165/183
4-113193 * 4/1992 (JP) ..... 165/153
4-155191 * 5/1992 (JP) ..... 165/153
9-170850 6/1997 (JP) .

* cited by examiner

*Primary Examiner*—Leonard Leo
(74) *Attorney, Agent, or Firm*—Harness, Dickey & Pierce, PLC

(57) ABSTRACT

A refrigerant passage of an evaporator, in which refrigerant flows, is divided into plural sub-passages by partition wall portions of inner fins. The partition wall portions have plural louvers for flowing the refrigerant from an air flow downstream side sub-passage to an ajdacent air flow upstream side sub-passage. The louvers are alternately arranged on the partition wall portions with specific intervals in a refrigerant flow direction. Accordingly, refrigerant distributed amounts into the plural sub-passages can be adjusted to correspond to variations in thermal load on an air side.

3 Claims, 9 Drawing Sheets

| SAMPLE NO. | ① (WITHOUT LOUVERS) | ② (PRESENT INVENTION) | ③ (PRESENT INVENTION) | ④ (BOTH-SIDE ARRANGEMENT) |
|---|---|---|---|---|
| RATIO OF LOUVER NUMBER | 0 | 1.0 (REFERENCE) | 1.7 | 3.0 |
| SCHEMATIC VIEW |  |   |   |   |
| Q (KW) | 5.525 (REFERENCE) | 5.632 (+1.94%) | 5.591 (+1.2%) | 5.517 (−0.14%) |
| ΔP (KPa) | 55.7 (REFERENCE) | 55.45 (−0.4%) | 60.86 (+9.3%) | 62.98 (+13%) |

REFRIGERANT EVAPORATOR INCLUDING REFRIGERANT PASSAGE WITH INNER FIN

CROSS REFERENCE TO RELATED APPLICATION

This application is based upon and claims the benefit of Japanese Patent Applications No. 10-28727 filed on Feb. 10, 1998, the contents of which are incorporated herein by reference.

BACKGROUND OF THE INVENTION

1. Field of the Invention

This invention relates to a refrigerant evaporator, which is suitable for an automotive air conditioner and includes plural flat refrigerant passages holding inner fins therein.

2. Description of the Related Art

A conventional refrigerant evaporator for an automotive air conditioner provides therein tube-like refrigerant passages defined by metallic thin plates laminated with one another and holding inner fins for increasing heat transfer areas on a refrigerant side. When the inner fins are bent to meander in a cross-section, the refrigerant passages are respectively divided by the meandering inner fins into several straight tube-like sub-passages in which refrigerant independently flows.

The inventor of the present invention has studied and examined this kind of refrigerant evaporator in which several sub-passages are independently provided in the respective refrigerant passages. As a result, it was found that the following phenomenon occurred to adversely affect evaporator characteristics.

That is, because the sub-passages divided by the meandering inner fins are completely independent in the evaporator, the refrigerant flowing in one of the sub-passages is not mixed with refrigerant flowing in the other sub-passages from an inlet to an outlet of the refrigerant passages. Therefore, when there arises variation (under and over supplies) in refrigerant distribution at the inlet of the refrigerant passages, the variation is kept until refrigerant flows out from the outlet.

In ordinary operational conditions of the evaporator, a volume of gaseous refrigerant is approximately 70 times as large as that of liquid refrigerant. Therefore, a flow resistance of gaseous refrigerant transformed from liquid refrigerant is significantly increased. When a gaseous refrigerant region is large, it becomes difficult for refrigerant to flow. In addition, when a refrigerant amount is short relative to a heat load on an air side in one of the sub-passages, refrigerant starts to evaporate at an upstream side more than that of the other sub-passages in which the refrigerant amount is not short, so that the gaseous refrigerant region in the one of the sub-passages is increased. This additionally promotes the refrigerant shortage caused by the under-supply.

On the other hand, in another one of the sub-passages in which the refrigerant amount is large, refrigerant starts to evaporate at a downstream side more than that in which the refrigerant amount is short. Therefore, the gaseous refrigerant region is relatively decreased so that refrigerant becomes liable to flow. As a result, the refrigerant excess caused by the over-supply is further promoted. That is, the under and over supplies of refrigerant into the sub-passages when the evaporator starts to be operated are further promoted during the heat exchange between refrigerant and air. Consequently, evaporator cooling property is prominently lowered as compared to an ideal state where evaporation (heat exchange) of refrigerant is uniformly performed in all of the sub-passages.

Further, temperature of air flowing in a heat exchanging part of the evaporator is lowered as air flows from an air flow upstream side to an air flow downstream side. Therefore, it is inevitable that an optimum refrigerant amount in the sub-passage provided at the air flow downstream side is smaller than that in the sub-passage provided at the air flow upstream side. Because of this, even when refrigerant is uniformly distributed into the sub-passages, refrigerant shortage inevitably occurs in the sub-passage at the air flow upstream side and refrigerant excess occurs in the sub-passage at the air flow downstream side.

To solve this problem, JP-U-59-76886 proposes a heat exchanger including a flat refrigerant passage, in which a corrugated inner fin formed with many louvers allowing refrigerant to flow from an air flow upstream side to an air flow downstream side is disposed therein. Accordingly, refrigerant shortage in a sub-passage at the air flow upstream side is relieved.

As a result of experimental studies on the above-describe heat exchanger by the inventor, however, it is founded that because the louvers are arranged on the entire area of the inner fin, pressure loss on the refrigerant side is increased by the louvers so that a refrigerant evaporation pressure in the evaporator is increased, resulting in decreased difference between refrigerant evaporation temperature and air temperature. Because of this, the cooling property of the heat exchanger adopting the louvers cannot be desirably improved, even when the number of the louvers is increased.

SUMMARY OF THE INVENTION

The present invention has been made in view of the above problems. An object of the present invention is to improve a cooling property of an evaporator providing therein refrigerant passages, each divided by an inner fin into plural sub-passages.

According to the present invention, a refrigerant passage of a heat exchanger is divided into a plurality of sub-passages by a plurality of partition wall portions of an inner fin. Each of the plurality of partition wall portions extends in a refrigerant flow direction and divides adjacent two of the plurality of sub-passages. Further, a plurality of refrigerant guide members are provided on the plurality of partition wall portions, for guiding the refrigerant from an air flow downstream side sub-passage into an air flow downstream side sub-passage. The plurality of refrigerant guide members are alternately provided on the partition wall portions at a specific interval in the refrigerant flow direction. As a result, refrigerant distributed amounts into the sub-passages are adjusted by the refrigerant guide members to correspond to variations in thermal load on an air side, thereby improving a cooling property of the heat exchanger.

The plurality of sub-passages can include first, second and third sub-passages arranged in parallel with the air flow direction so that the first sub-passage is disposed on an air flow upstream side more than the second and third sub-passages, and so that the second sub-passage is disposed on an air flow upstream side more than the third sub-passage. Further, the plurality of partition wall portions can include first and second partition wall portions dividing the first and second sub-passages and the second and third sub-passages, respectively. Further, the plurality of refrigerant guide members can include a first plurality of refrigerant guide members provided on the first partition wall portion with a first interval in the refrigerant flow direction, and a second plurality of refrigerant guide members provided on the second partition wall portion with a second interval in the refrigerant flow direction. In this case, the second plurality refrigerant guide members are shifted from the first plurality of refrigerant guide members in the refrigerant flow direction.

More preferably, the first plurality of refrigerant guide members are arranged on the first partition wall portion with first interval spaces in the refrigerant flow direction, and the second plurality of refrigerant guide members are arranged on the second partition wall portion with second interval spaces in the refrigerant flow direction so as to face the first interval spaces in a direction perpendicular to the refrigerant flow direction.

BRIEF DESCRIPTION OF THE DRAWINGS

Other objects and features of the present invention will become more readily apparent from a better understanding of the preferred embodiment described below with reference to the following drawings.

DETAILED DESCRIPTION OF THE PREFERRED EMBODIMENT

Figure 1:
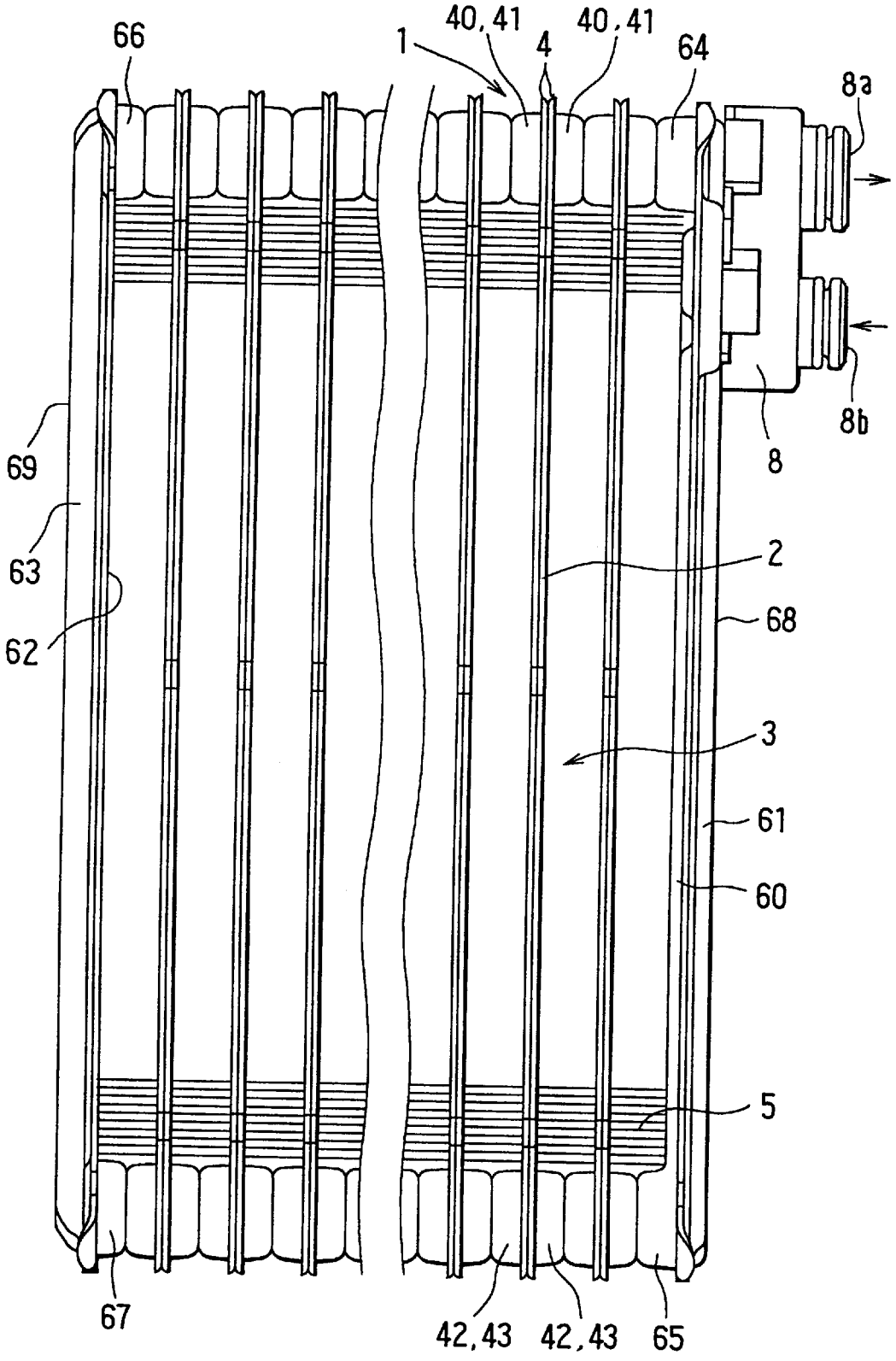
FIG. 1 is a patially broken front view showing an evaporator in a preferred embodiment of the present invention.

An evaporator 1 in a preferred embodiment is shown in FIG. 1. The evaporator 1 is to be accommodated in an air conditioning unit case (not shown) of an automotive air conditioner so that a vertical direction thereof in the unit case corresponds to a vertical direction thereof in FIG. 1. In the unit, air from an air conditioning blower flows in a direction perpendicular to the paper space of FIG. 1, i.e., in a direction indicated by an arrow A in FIGS. 3 and 4. Low temperature and low pressure gas-liquid two-phase refrigerant, which is decompressed by a thermostatic expansion valve (not shown) to expand, flows into the evaporator 1.

Figure 3:
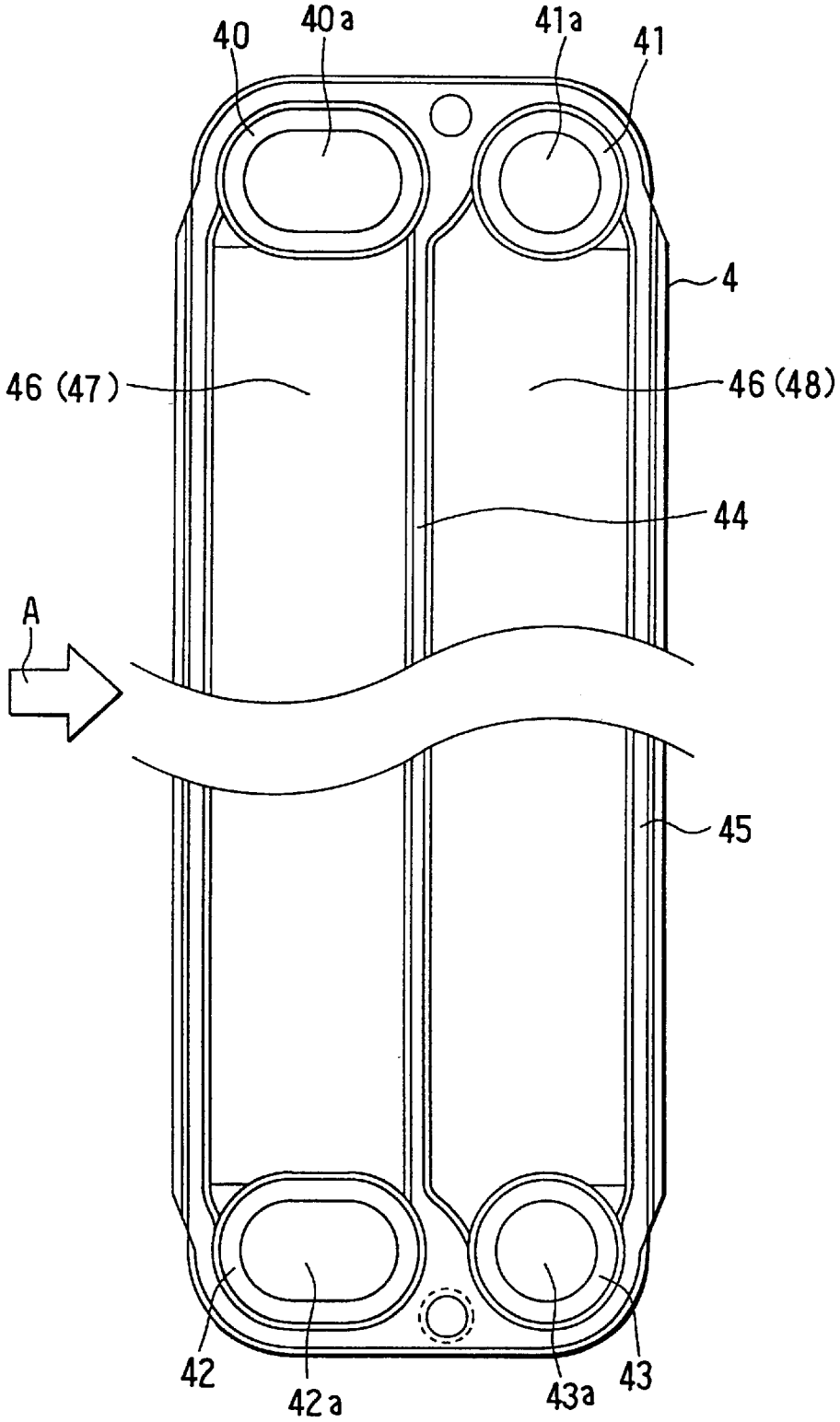
FIG. 3 is a partially broken front view showng a metallic thin plate consituting a tube of the evaporator shown in FIG. 1.

As shown in FIG. 1, the evaporator 1 includes plural tubes 2 arranged in parallel with one another, which constitute a heat exchange part 3 for exchanging heat between refrigerant flowing inside the tubes 2 and conditioning air flowing outside the tubes 2. Accordingly, refrigerant evaporates in the tubes 2. The tubes 2 have a lamination structure composed of plural metallic thin plates (core plates) 4. The lamination structure is disclosed in, for example, JP-A-9-170850. Each of the metallic thin plates 4 is composed of an aluminum core member, both surfaces of which are clad with brazing filler metal, and is formed into a specific shape as shown in FIG. 3. The metallic thin plates 4 form plural pairs laminated with and joined to one another by brazing, thereby forming the tubes 2.

As shown in FIG. 3, each of the metallic thin plates 4 has two cup-like tank portions 40, 41 on an end thereof and two cup-like tank portions 42, 43 on the other end thereof. The tank portions 40–43 protrude in a direction approximately perpendicular to the thin plate 4, i.e., in a lamination direction, and define communication holes 40*a*–43*a* therein, through which the refrigerant passages provided in the tubes 2 communicate with one another on the upper and lower ends of the refrigerant passages.

The shape of each metallic thin plate 4 is explained in more detail. The metallic thin plate 4 has a rib-like central partition part 44 extending in a longitudinal direction thereof at the central portion in a width direction thereof, and a rib-like peripheral joining part 45 disposed on the entire peripheral portion of the metallic thin plate 4. The metallic thin plate 4 further has two concave parts 46 extending in parallel with one another between the central partition part 44 and the peripheral joining part 45. The concave parts 46 are dented outward at a specific dimension from the surfaces of both parts 44, 45. Accordingly, when two metallic thin plates 4 joined to one another at the central partition part 44 and the peripheral joining part 45, two refrigerant passages 47, 48 are provided in parallel on both sides of the central partition part 44. For example, when both the upper side tank portions 40, 41 serve as part of a refrigerant inlet side tank and both the lower side tank portions 42, 43 serve as part of a refrigerant outlet side tank, refrigerant flows from the upper side to the lower side in the refrigerant passages 47, 48.

Figure 4:
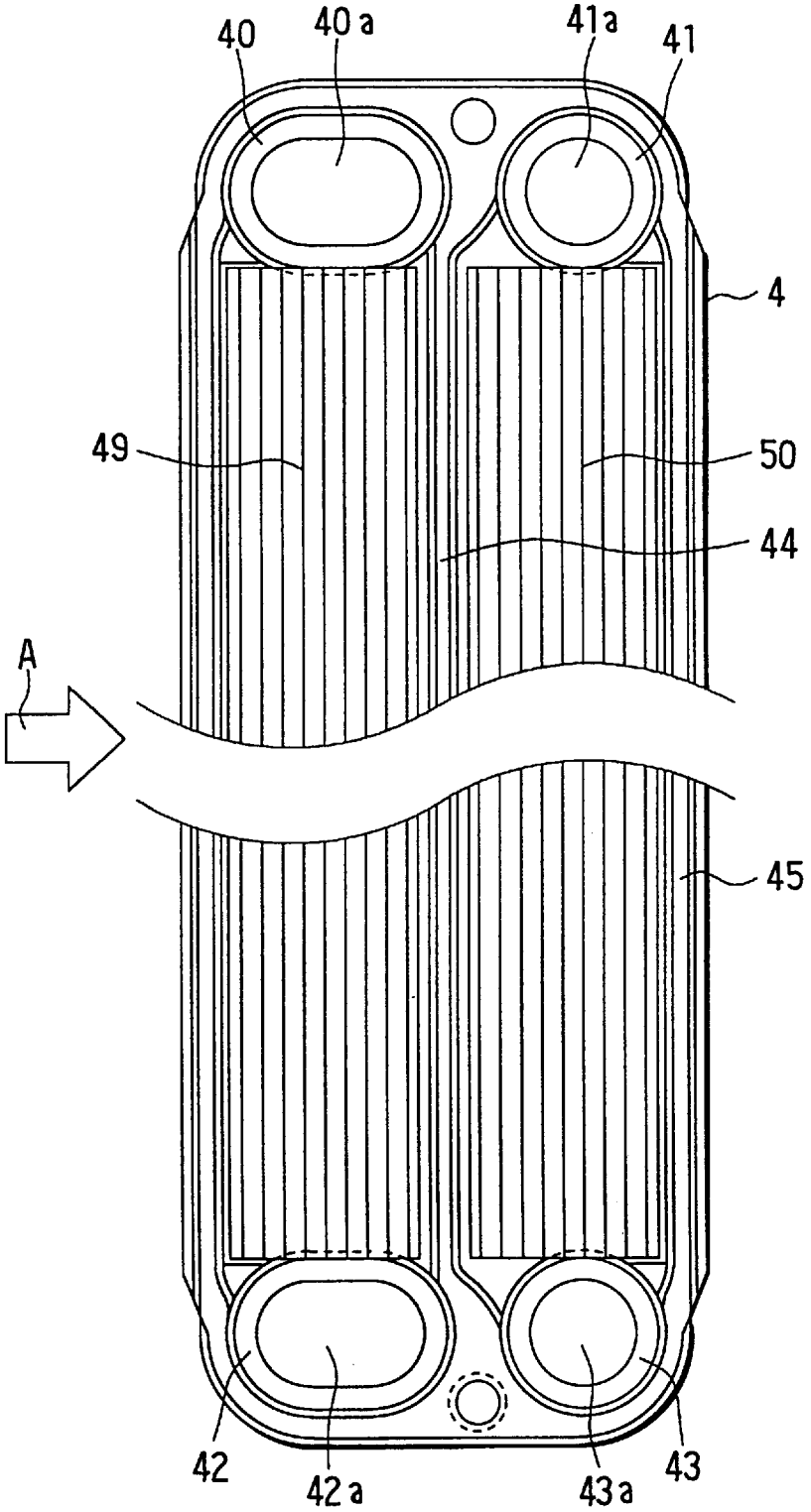
FIG. 4 is a partially broken front view showing a state where inner fins are attached to the metallic thin plate shown in FIG. 3.

As shown in FIG. 4, inner fins 49, 50 are disposed in the refrigerant passages 47, 48, respectively. The inner fins 49, 50 are formed by bending to meander in a direction perpendicular to the refrigerant flow direction, i.e., perpendicular to the vertical direction in FIGS. 3 and 4. Further, referring again to FIG. 1, corrugated fins 5 are disposed between the respective adjacent two tubes 2 and are joined to the outer surfaces of the tubes 2 so that a heat transfer area on the air side is increased. Each of the corrugated fins 5 is composed of an aluminum bare member, which is not covered with brazing filler metal and is formed by bending into a meandering shape.

An end plate 60 is disposed at an end (right side end in FIG. 1) of the heat exchange part 3 in the lamination direction of the metallic thin plates 4, and a side plate 61 is joined to the end plate 60. Further, another end plate 62 is disposed at the other end (left side end in FIG. 1) of the heat exchange part 3 in the lamination direction, and a side plate 63 is joined to the end plate 62. Both surfaces of the respective end plates 60, 62 and the side plates 61, 64 are clad with brazing filler metal similarly to the metallic thin plates 4. Each thickness of these plates 60–63 is thicker than that of the metallic thin plates 4 in view of mechanical strength. For example, the thickness of the plates 60–63 is approximately 1 mm.

Figure 2:
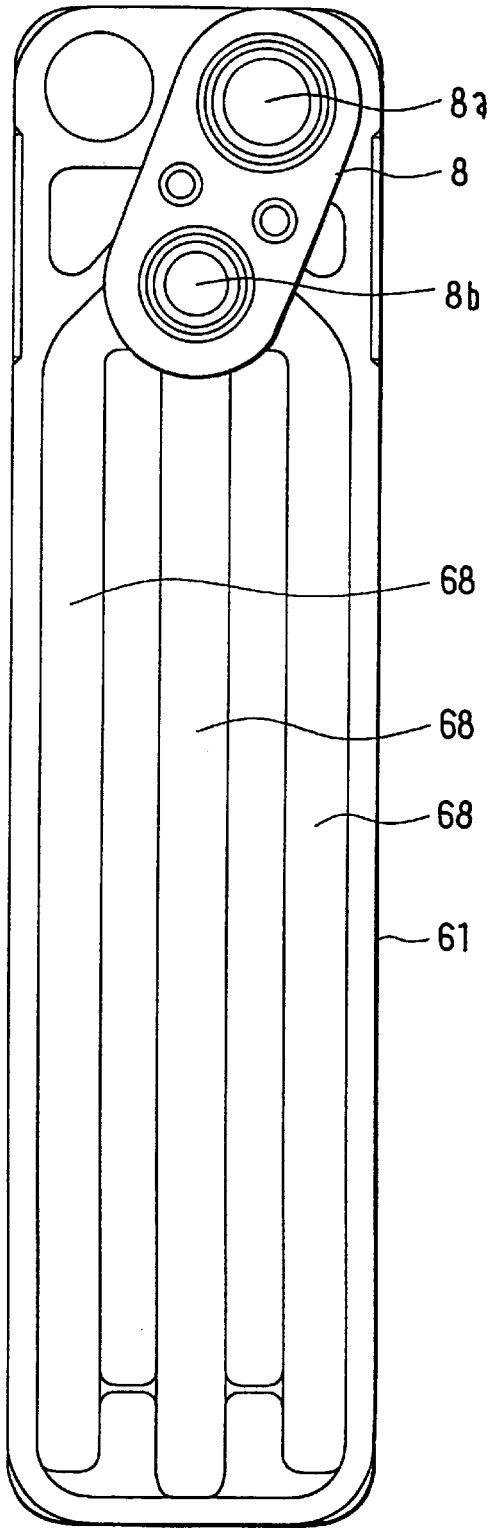
FIG. 2 is a side view showing the evaporator from the right side of FIG. 1.

Each of the end plates 60, 62 has tank portions 64–67 similar to the tank portions 40–43 of the metallic thin plates 4. As shown in FIG. 2, the side plate 61 on the right side has protruding portions 68 for defining a side refrigerant passage therein, and likewise, the side plate 63 on the left side has protruding portions 69 for defining a side refrigerant passage therein. A pipe joint member 8 is joined to the side plate 61 on the right side. The pipe joint member 8 is composed of an elliptically and cylindrically shaped aluminum bare block member, and a refrigerant outlet hole 8*a* and a refrigerant inlet hole 8*b*, which are to be connected to an external refrigerant circuit, are formed to pass through the pipe joint member 8 in a thickness direction, i.e., an axial direction of the joint member 8.

The refrigerant outlet hole 8*a* communicates with the tank portion 40 that is disposed on an air flow upstream side in the upper tank portions, and allows evaporated gaseous refrigerant to flow out of the evaporator 1. The refrigerant outlet hole 8*a* is connected to a suction pipe of a compressor (not shown). The refrigerant inlet hole 8*b* is connected to an outlet side refrigerant pipe of an expansion valve (not shown) to receive gas-liquid two-phase refrigerant from the expansion valve, and transfer the refrigerant into the tank portion 43 that is disposed on an air flow downstream side in the lower tank portions through the side refrigerant passage provided within the protruding portions 68.

Next, a method of manufacturing the evaporator 1 will be explained. First, the metallic thin plates 4 for constituting the tubes 2, the inner fins 49, 50, the corrugated fins 5 and the like are provisionally assembled in the lamination state shown in FIG. 1. The thus provisionally assembled member is transferred into a furnace while keeping its provisionally assembled state by a specific jig and the like. Next, the provisionally assembled member is heated up to a melting point (around 600° C.) of the brazing filler metal used for aluminum clad members. Accordingly, respective parts of the evaporator 1 are integrated with one another at joining portions therebetween.

Figure 5:
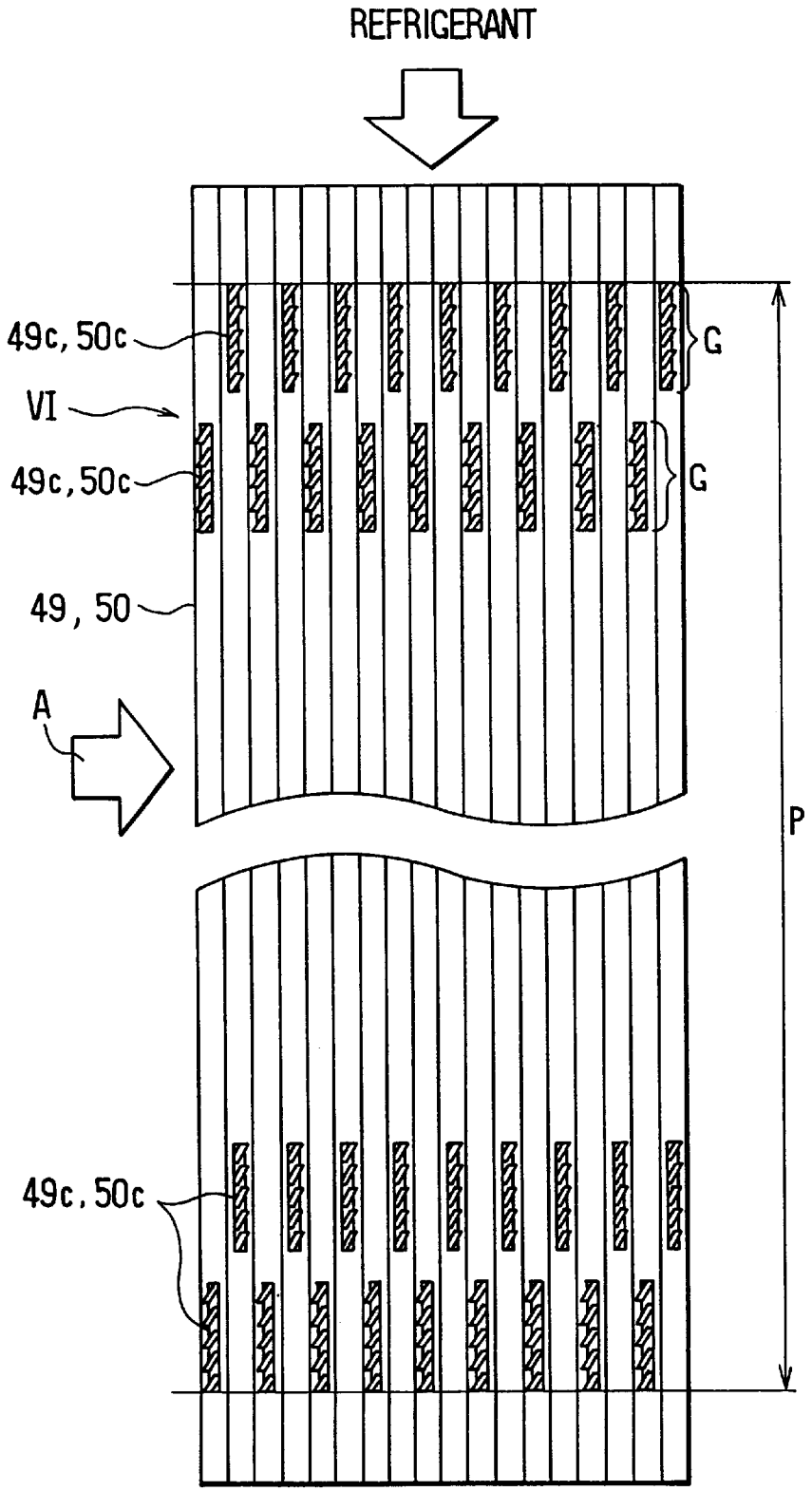
FIG. 5 is a partially brokedn front view showing one the inner fins.
Figure 6:
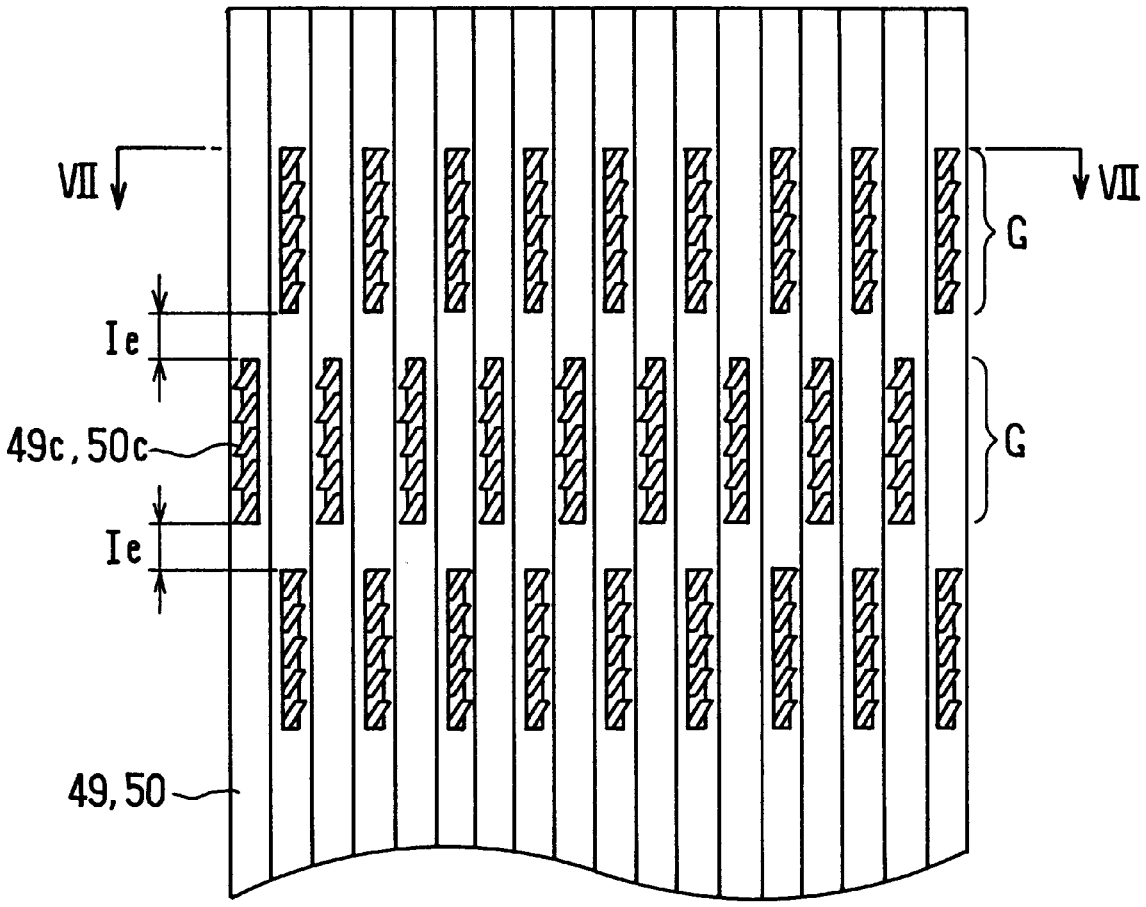
FIG. 6 is an enlarged view of portion VI in FIG. 5.
Figure 7:
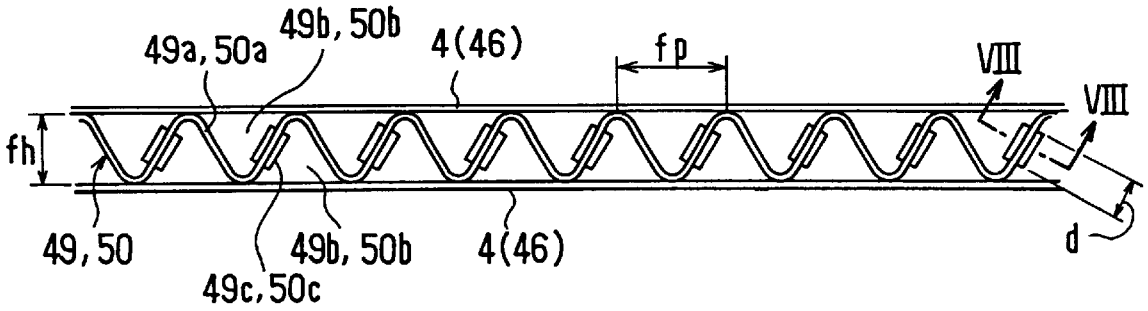
FIG. 7 is a cross-sectional view taken along a VII—VII line in FIG. 6.

FIGS. 5–8 show a specific shape of each of the inner fins 49, 50. The inner fins 49, 50 are respectively composed of an aluminum bare thin plate, which is non-clad with brazing filler metal and has a thickness of, for example, 0.1 mm. As shown in FIG. 7, the inner fins 49, 50 are specifically corrugated with arc-like smoothly bent portions, and the arc-like bent portions abut the inner walls of the concave parts 4.6 of the metallic thin plates 4 and are joined to the inner walls by brazing. For example, in this embodiment, a fin height fh of the inner fins is 2.0 mm, and a fin pitch fp of the inner fins is 2.6 mm.

Accordingly, flat wall parts respectively provided between the adjacent two arc-like bent portions of the inner fins 49, 50 serve as partition wall portions 49*a*, 50*a* for dividing the refrigerant passages 47, 48 into plural sub-passages 49*b*, 50*b* along the refrigerant flow direction. That is, the plural sub-passages 49*b*, 50*b* are partitioned by the plural partition wall portions 49*a*, 50*a* of the inner fins 49, 50 elongating in parallel with the refrigerant flow direction between the opposite concave portions 46.

Figure 8:
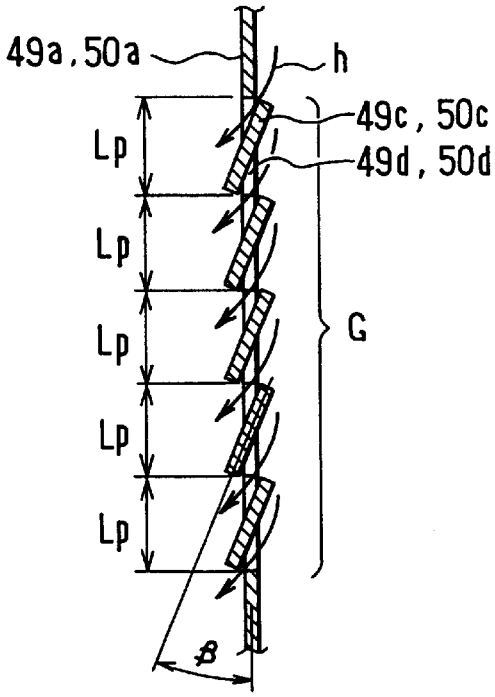
FIG. 8 is a cross-sectional view taken along an VIII—VIII line in FIG. 7.

Further, plural louvers (refrigerant guiding members) 49*c*, 50*c* are provided on the partition wall portions 49*a*, 50*a*, and allow refrigerant to flow from the air flow downstream side to the air flow upstream side therethrough. More specifically, the louvers 49*c*, 50*c* are formed alternately on the partition wall portions 49*a*, 50*a*, in the meandering direction of the inner fins 49, 50. As shown in FIG. 8, each of the louvers 49*c*, 50*c* is a rectangular plate-like split, which is cut and bent up from the partition wall portions 49*a*, 50*a* with a specific angle β (for example, 45°) relative to the flat surface of the respective partition wall portions 49*a*, 50*a*.

Accordingly, the louvers 49*c*, 50*c* respectively provide communication holes 49*d*, 50*d* in the partition wall portions 49*a*, 50*a*. The specific angle β of the louvers 49*c*, 50*c* makes it possible that refrigerant flows from the sub-passage 49*b*, 50*b* on the air flow downstream side to the sub-passage 49*b*, 50*b* on the air flow upstream side through the communication holes 49*d*, 50*d*. In this embodiment, five louvers 49*c*, 50*c*, arranged in parallel to the refrigerant flow direction at a specific pitch (louver pitch) Lp, form a louver group G. For example, the louver pitch is 1.0 mm. Further, referring again to FIG. 7, a width of each louver d parallel to the flat surface of the respective partition wall portions 49*a*, 50*a* is 1.5 mm.

An entire arrangement of the louver groups G will be explained in more detail referring to FIGS. 5 and 6. The louver groups G are arranged in the refrigerant flow direction at a specific interval Ie (for example, 1.5 mm) entirely in a length direction region P. Further, the positions where the louver groups G are formed are alternately shifted from one another in the meandering direction of the inner fins.

Next, an operation of the evaporator 1 having the constitution described above will be explained. Low-temperature and low-pressure gas-liquid two-phase refrigerant, which has been decompressed in the expansion valve, flows in the refrigerant passages 47, 48 formed within the tubes 2, for example, from the upper side to the lower side in FIG. 3. At that time, refrigerant evaporates by exchanging heat, via the corrugated fins 5, with conditioning air passing through the heat exchange part 3, i.e., by absorbing heat from conditioning air.

Figure 9A:
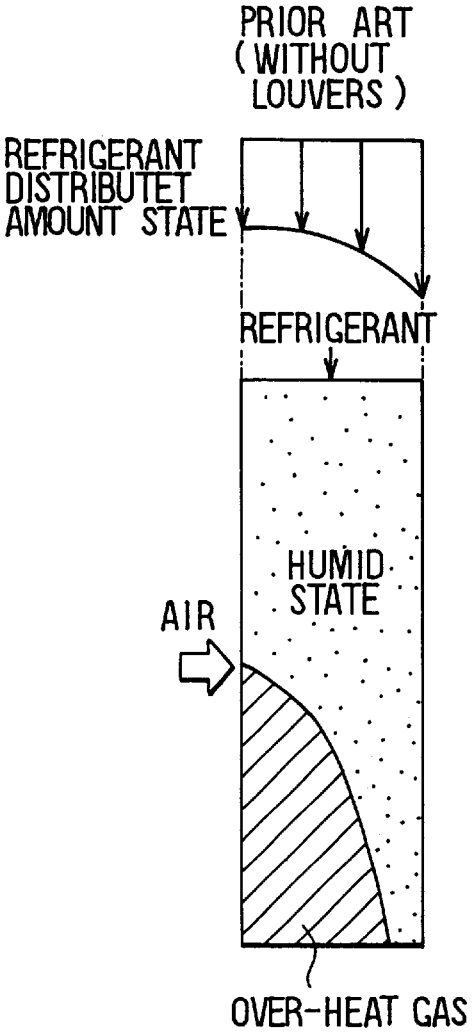
FIGS. 9A and 9B are explanatory views for explaining refrigerant states in inner fin sub-passages.

The refrigerant flow in the refrigerant passages 47, 48 will be described in more detail. When the partition wall portions 49*a*, 50*a* have no communication means as in a conventional manner, refrigerant independently f lows in the respective sub-passages 49*b*, 50*b*. In this case, a refrigerant amount in an air flow upstream side sub-passage becomes short, while a refrigerant amount in an air flow downstream side sub-passage becomes excessive. As a result, as shown in FIG. 9A, a large over-heat gas region is produced in the air flow upstream side sub-passage, thereby compromising evaporator properties.

To the contrary, in the present embodiment, the louvers 49*c*, 50*c* are formed on the partition wall portions 49*a*, 50*a* by cutting and bending up the partition wall portions 49*a*, 50*a* with the specific angle β so that refrigerant flows from an air flow downstream side sup-passage 49*b*, 50*b* to the adjacent air flow upstream side sub-passage 49*b*, 50*b*.

In each sub-passage 49*b*, 50*b*, gaseous refrigerant having small viscosity flows in the central portion of the sub-passage, while liquid refrigerant having large viscosity flows on the peripheral side of the sub-passage adjacent to the passage inside walls. That is, refrigerant flows in the sub-passage as a so-called annular flow. Therefore, the louvers 49*c*, 50*c* effectively guide liquid refrigerant on the peripheral side from the upstream side sub-passage into the downstream side sub-passage as indicated by arrows h in FIG. 8.

Figure 9B:
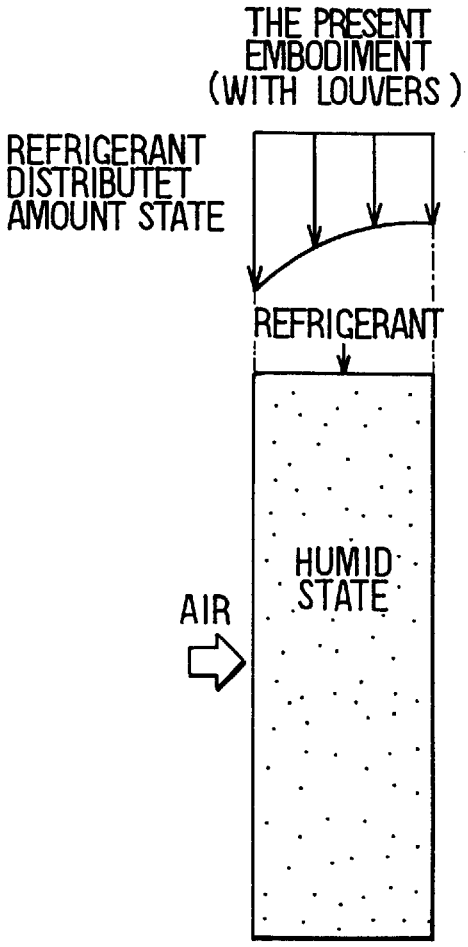

As a result, the refrigerant amount flowing in the air flow upstream side sub-passage 49*b*, 50*b* can be increased as compared to that in the air flow downstream side sub-passage 49*b*, 50*b*. The refrigerant distributed amounts on the air flow upstream and downstream sides can be adjusted to correspond to variations in thermal load on the air side. Therefore, as shown in FIG. 9B, according to this embodiment, refrigerant flowing in one of the tubes 2 can be a humid state entirely in the plural sub-passages 40*b*, 50*b* from the upstream side to the downstream side, as compared to the conventional case shown in FIG. 9A. In this embodiment, a over-heat gas region is prevented from being generated in the sub-passages, so that air can be effectively and uniformly cooled down on the entire surface of the tubes 2.

Further, a notable point in this embodiment is that the louvers 49*c*, 50*c* are not arranged entirely and uniformly on the partition wall portions 49*a*, 50*a* of the inner fins 49, 50, but are arranged with a specific arrangement specifically shown in FIGS. 5 to 7. Therefore, concerning one of the sub-passages 49*b*, 50*b*, a portion where the louvers 49*c*, 50*c* are formed and a portion where the louvers 49*c*, 50*c* are not formed are alternately provided along the refrigerant flow direction. This arrangement of the louvers 49*c*, 50*c* prevents a pressure loss (flow resistance) increase in each of the sub-passages 49*b*, 50*b*.

The pressure loss increase in each of the sub-passages 49*b*, 50*b* increases refrigerant evaporation pressure of the evaporator as a whole, resulting in rise in refrigerant evaporator temperature. The rise in refrigerant evaporator temperature compromises evaporator properties. However, in this embodiment, the pressure loss increase in the sub-passages 49*b*, 50*b* can be effectively prevented due to the reasons described above, so that the increase in the refrigerant evaporation pressure (refrigerant evaporator temperature) is suppressed at a very small amount. Consequently, the property improvement caused by the uniform refrigerant distribution shown in FIG. 9B can be effectively exhibited, and the cooling capacity of the evaporator as a whole is improved.

Next, experimental results indicating differences in evaporator properties based on differences in inner fin shapes will be explained referring to FIG. 10. Samples ① and ④ correspond to prior arts, respectively. Specifically, sample ④ corresponds to an inner fin disclosed in JP-U-59-76886. Inner fins of samples ①–④ respectively have a fin pitch fp of 2.6 mm and a fin height fh of 2.0 mm. The inner fins of samples ②–④ have louvers, respectively. In the inner fins of samples 2̂ and 1̂, a louver pitch Lp is 1.0 mm, a width d of each louver is 1.5 mm, and a louver inclined angle β is 45°.

The inner fins of samples ② and ③ have louvers alternately arranged thereon as in the present embodiment, while the inner fin of sample ④ has louvers entirely and uniformly provided thereon with a both-side arrangement. Schematic views of FIG. 10 show dimensions (mm) of louver arrangements, respectively. A ratio of louver number indicated in FIG. 10 represents a ratio of a louver number of each sample relative to a louver number of sample ②. In other words, the louver number of sample ③ is 1.7 times, and the louver number of sample ④ is 3.0 times as larger as that of sample ④.

The inner fins of samples ①–④ were assembled in refrigerant passages of evaporators, respectively, and then cooling properties Q (KW) and pressure losses ΔP (KPa) of the evaporators were measured. The results are shown in FIG. 10. Values indicated with parentheses in FIG. 10 are increase or decrease percentages of the respective cooling capacities and the respective pressure losses relative to references. In this case, the references are a cooling capacity and a pressure loss obtained from the evaporator in which the inner fin of sample ① (straight type inner fin) is assembled.

Experimental conditions on an air flow side are 500 $m^3/h$ in an amount of air sent into the evaporator, 27° C. in temperature of the air, and 50% in humidity of the air. Experimental conditions on a refrigerating cycle side are 0.18 MPa in an evaporator outlet side low-pressure, 10° C. in an over-heating degree of evaporator outlet side refrigerant, 1.64 MPA in a high-pressure, and 3° C. in a super-cooling degree of high-pressure liquid refrigerant.

Figure 10:
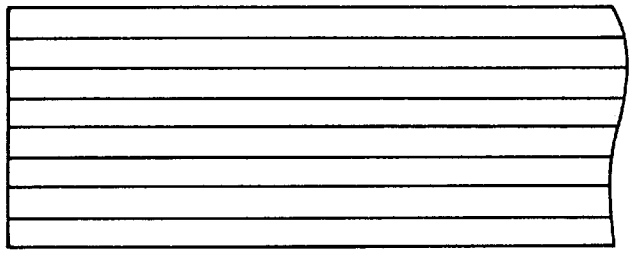
FIG. 10 is a table showing experimental results performed on inner fins according to the present invention, and inner fins according to prior arts.
Figure 10:
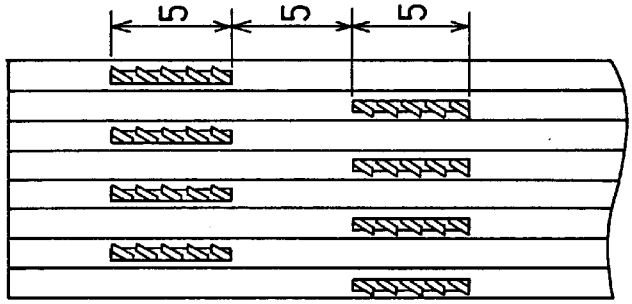
Figure 10:
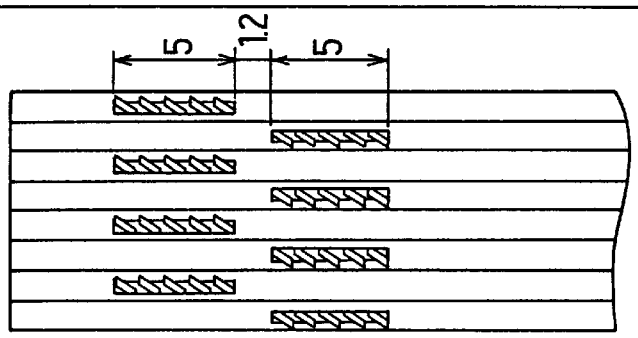
Figure 10:
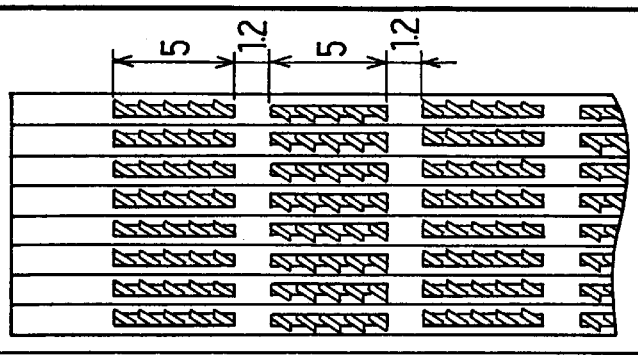

As understood from the experimental results shown in FIG. 10, both the inner fins of samples ② and ③ according to the present invention improve the cooling capacity Q as compared to those of the straight type inner fin of sample ①.

Especially, the inner fin of sample ② can decrease the pressure loss ΔP than that of sample ① by 0.4%. Accordingly, the inner fin of sample ② can improved the cooling capacity Q by approximately 2%. In the inner fin of sample ②, the louver number is optimized and the interval between the respective louver groups is increased to be approximately equal to the length (5 mm) of the respective louver groups in the refrigerant flow direction, so that pressure losses in the respective sub-passages are decreased by preventing the generation of the over-heat gas regions. The inner fin of sample ③ increases the pressure loss ΔP by 9.3%, but improves the cooling capacity Q by 1.2%.

To the contrary, the both-side arrangement inner fin of sample ④ according to a prior art increases the pressure loss ΔP by 13.0%, resulting in significant increase in evaporation pressure (evaporation temperature). Therefore, the inner fin has louvers thereon; nevertheless, the cooling capacity Q deteriorates by 0.14%. Accordingly, it is found that when the louver groups are arranged at an interval Ie approximately equal to the length of the louver group in the refrigerant flow direction, the cooling property is further improved.

While the present invention has been shown and described with reference to the foregoing preferred embodiment, it will be apparent to those skilled in the art that changes in form and detail may be made therein without departing from the scope of the invention as defined in the appended claim.

Specifically, the present invention is directed to an improvement of refrigerant distributed amounts into the sub-passages 49*b*, 50*b*. Therefore, structures other than the inner fins, such as a structure of the refrigerant passages can be changed. For example, each of the tubes 2 provide therein two partitioned refrigerant passages 47, 48; however, it may provide therein only one refrigerant passage.

Although the tubes 2 (metallic thin plates 4) have the tank portions 40–43 at both end portions in the longitudinal direction thereof, the tubes 2 alternatively may have tank portions only at one end portion in the longitudinal direction thereof. In this case, refrigerant is made U-turn at the other end portion in the longitudinal direction of the tubes.

Figure 11:
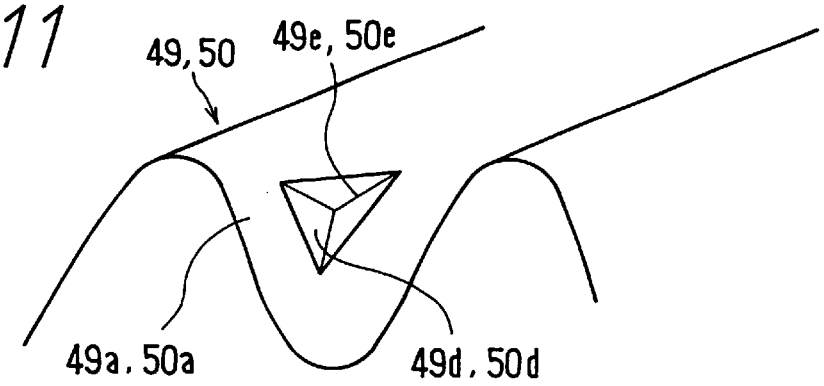
FIG. 11 is a perspective view partially showing an inner fin as a modified example according to the present invention.

Also, the louvers 49*c*, 50*c* are plate-like splits cut and bent up from the partition wall portions 49*a*, 50*a* of the inner fins 49, 50; however, each shape and structure of the louvers 49*c*, 50*c* are not limited to that and are changeable. For example, as shown in FIG. 11, triangular pyramid-like projections 49*e*, 50*e* projecting from the partition wall portions 49*a*, 50*a* and having communication holes 49*d*, 50*d* open in side faces thereof may be formed on the inner fins 49, 50. Also, the inner fins 49, 50 are formed by bending to meander with arc-like smoothly bent portions; however, they may be formed to have angular, for example, perpendicularly bent portions.

What is claimed is:

1. A heat exchanger including a refrigerant passage in which refrigerant flows in a refrigerant flow direction, for exchanging heat between the refrigerant and an air flowing outside the refrigerant passage in an air flow direction perpendicular to the refrigerant flow direction, the heat exchanger comprising:

a tube defining therein the refrigerant passage;

an inner fin having a plurality of partition wall portions and dividing the refrigerant passage into a plurality of sub-passages by the plurality of partition wall portions, the plurality of sub-passages including first, second, and third sub-passages so that the first sub-passage is disposed on an air flow upstream side more than the second and third sub-passages, the plurality of partition wall portions including first and second wall portions respectively dividing the first and second sub-passages and the second and third sub-passages;

a first group of louvers provided on the first partition wall portion for guiding the refrigerant from the second sub-passage into the first sub-passage;

a second group of louvers provided on the second partition wall portion for guiding the refrigerant from the third sub-passage into the second sub-passage, the second group of louvers being shifted from the first group of louvers in the refrigerant flow direction to avoid overlapping with the first group of louvers in the air flow direction;

a plurality of first groups of louvers provided on the first partition wall portion at a first interval to define first interval spaces therebetween in the refrigerant flow direction; and a plurality of second groups of louvers provided on the second partition wall portion at a second interval to define second interval spaces therebetween in the refrigerant flow direction and to respectively face the first interval spaces in a direction perpendicular to the refrigerant flow direction;

wherein each length of the first group of louvers and the second group of louvers in the refrigerant flow direction is approximately equal to that of each of the first and second intervals.

2. The heat exchanger of claim 1, wherein the first interval is equal to the second interval.

3. The heat exchanger of claim 5, wherein each of the first groups of louvers and the second groups of louvers includes a plurality of louvers bent up from the first and second partition wall portions and arranged in the refrigerant flow direction.

* * * * *